US007441917B1

(12) United States Patent
Underdown et al.

(10) Patent No.: US 7,441,917 B1
(45) Date of Patent: Oct. 28, 2008

(54) ILLUMINATED JEWELRY

(76) Inventors: Will Underdown, 149 NW. 70th St., #213, Boca Raton, FL (US) 33487; Janet L. Falbo, 149 NW. 70th St., #213, Boca Raton, FL (US) 33487

( * ) Notice: Subject to any disclaimer, the term of this patent is extended or adjusted under 35 U.S.C. 154(b) by 0 days.

(21) Appl. No.: 11/436,938

(22) Filed: May 18, 2006

Related U.S. Application Data

(60) Provisional application No. 60/682,363, filed on May 18, 2005.

(51) Int. Cl.
*A44C 5/00* (2006.01)

(52) U.S. Cl. ..... 362/103; 362/104

(58) Field of Classification Search ..... 362/104, 362/183, 252; 63/3, 3.1
See application file for complete search history.

(56) References Cited

U.S. PATENT DOCUMENTS 5,477,433 A * 12/1995 Ohlund ..... 362/104
5,806,346 A * 9/1998 Schlinger et al. ..... 63/40
6,122,933 A 9/2000 Ohlund
6,601,965 B2 8/2003 Kamara
6,626,009 B1 * 9/2003 Ohlund ..... 63/3.1
7,104,668 B1 * 9/2006 Lee ..... 362/104

* cited by examiner

*Primary Examiner*—Anabel M Ton
(74) *Attorney, Agent, or Firm*—Malin Haley DiMaggio Bowen & Lhota, P.A.

(57) ABSTRACT

An illuminated jewelry article having a conductor loop, a magnetically connectable clasp housing a removable battery, and a medallion having internal light emitting diode ("LED"). The clasp consists of two magnetically connectable clasp components, at least one of which is adapted with an interior chamber for containing a battery power source. Each clasp component includes a vertex end connected to an electrical conductor, and a magnetically attractable base. At least one of the clasp components contains a magnet thereby allowing the clasp components to be magnetically connectable in base-to-base relation without requiring precise manual alignment. No further mechanical connection is required. Once connected the clasp completes an electrical circuit resulting in the illumination of an LED electrically connected to the necklace opposite the clasp portion. The LED is preferably connected to or embedded within a crystal to enhance the illumination effect. The conductor loop preferably includes an external coil that functions to maintain the conductor run from the clasp section to the pendant section in a generally arcuate configuration.

15 Claims, 12 Drawing Sheets

ILLUMINATED JEWELRY

CROSS REFERENCE TO RELATED APPLICATIONS

This application claims the benefit of provisional U.S. Patent Application Ser. No. 60/682,363, filed on May 18, 2005.

STATEMENT REGARDING FEDERALLY SPONSORED RESEARCH OR DEVELOPMENT

N/A

COPYRIGHT NOTICE

A portion of the disclosure of this patent document contains material that is subject to copyright protection. The copyright owner has no objection to the facsimile reproduction by anyone of the patent document or patent disclosure as it appears in the Patent and Trademark Office patent file or records, but otherwise reserves all copyrights rights whatsoever.

BACKGROUND OF THE INVENTION

1. Field of the Invention

The present invention relates to jewelry, and more particularly to a necklace or bracelet adapted with a battery and light-emitting device for providing an illumination effect.

2. Description of Related Art

The market for jewelry is substantial and diverse. As a result, there exist a wide variety of jewelry designs. For example, jewelry designs span a large range from simple to complex, and from expensive fine jewelry pieces to less expensive costume jewelry pieces. Among these designs are several lighted jewelry pieces including illuminated earrings and lighted pendants.

U.S. Pat. No. 6,601,965, issued to Kamara, discloses a necklace having an illuminated medallion with a conductor loop coated with non-conductive material, and connected to the conductor loop a clasp that houses a removable battery, and a bead having and internally embedded LED. The prior art necklace disclosed by Kamara is depicted herein in FIGS. 1-3, and is burdened by significant disadvantages. More particularly, the clasp consists of two generally cylindrical pieces require the user to manipulate the pieces into a press fit configuration as depicted in FIGS. 2 and 3. The clasp is thus not only difficult to connect, but results in misalignment of the necklace/conductor ends when in the connected configuration.

U.S. Pat. No. 6,122,933, issued to Ohlund, discloses a jewelry piece having a loop conductor with an LED and a clasp housing a battery. The clasp disclosed by Ohlund has similar disadvantages to that disclosed by Kamara. More particularly, the Ohlund clasp requires the user to make a threaded connection and results in misalignment of the necklace/conductor ends.

Accordingly, there exists a need for illuminated jewelry having an improved clasp that is easily connected and results in alignment of the necklace ends.

BRIEF SUMMARY OF THE INVENTION

The present invention overcomes the disadvantages in the art by providing an improved an illuminated jewelry article having a conductor loop, a magnetically connectable clasp housing a removable battery, and a medallion having internal light emitting diode ("LED"). The clasp consists of two magnetically connectable clasp components, at least one of which is adapted with an interior chamber for containing a battery power source. Each clasp component includes a vertex end connected to an electrical conductor, and a magnetically attractable base. At least one of the clasp components contains a magnet thereby allowing the clasp components to be magnetically connectable in base-to-base relation without requiring precise manual alignment. No further mechanical connection is required. Once connected the clasp completes an electrical circuit resulting in the illumination of an LED electrically connected to the necklace opposite the clasp portion. The LED is preferably connected to or embedded within a crystal to enhance the illumination effect. The conductor loop preferably includes an external coil that functions to maintain the conductor run from the clasp section to the pendant section in a generally arcuate configuration.

Accordingly, it is an object of the present invention to provide improvements in the field of illuminating jewelry.

Still another object of the present invention is to provide an improved clasp for jewelry.

Yet another object of the present invention is to provide a magnetically connectable clasp for jewelry.

Another object of the present invention is to provide an illuminated necklace having a magnetically connectable clasp.

Still another object of the present invention is to provide such a jewelry item wherein the clasp further functions as a battery housing.

Another object of the present invention is to provide an illuminated necklace having an improved conductor assembly that maintains the necklace in a generally arcuate shape while resisting crimping or kinking.

In accordance with these and other objects, which will become apparent hereinafter, the instant invention will now be described with particular reference to the accompanying drawings.

DETAILED DESCRIPTION OF THE INVENTION

Figure 1:
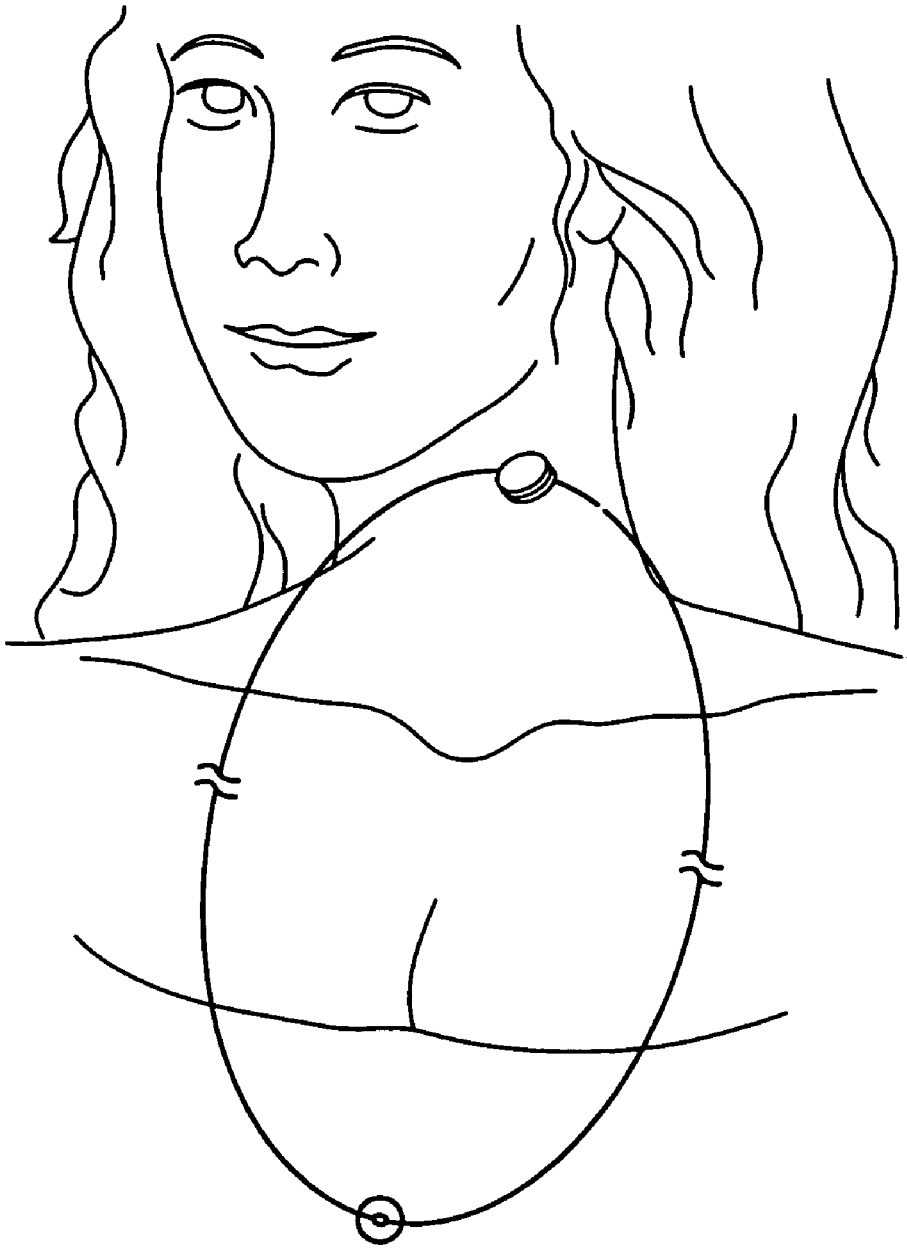
FIG. 1 PRIOR ART
FIG. 1 shows a prior art illuminated necklace.
Figure 2:
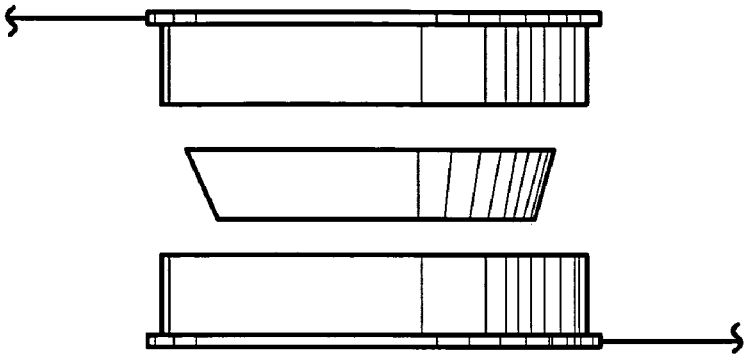
FIG. 2 PRIOR ART
FIGS. 2 and 3 depict detailed views of a press fit clasp for use with the prior art illuminated necklace.
Figure 3:
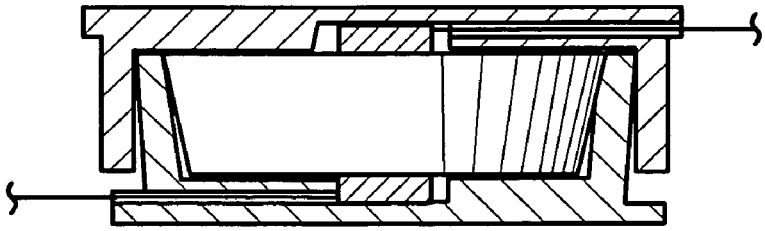
FIG. 3 PRIOR ART
Figure 4:
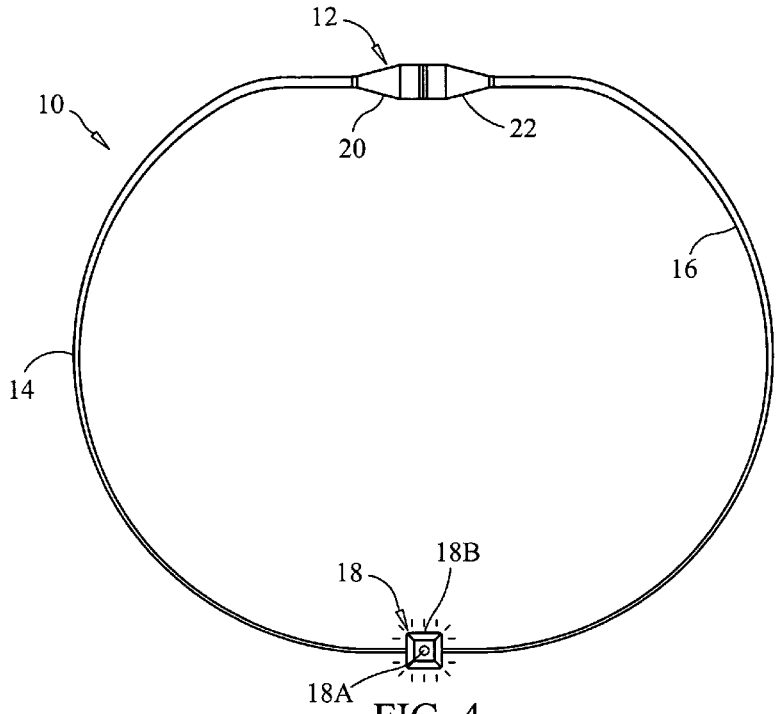
FIG. 4 depicts an illuminated necklace in accordance with the present invention.

With reference now to the drawings there is depicted an illuminated necklace 10 in accordance with the present invention. FIGS. 1-3 depict an illuminated necklace in accordance with the prior art. FIG. 4 depicts an illuminated necklace 10 in accordance with the present invention. Necklace 10 includes a clasp 12 having at least one internal battery compartment, electrical conductor assemblies, generally referenced as 14 and 16, connected to clasp 12, and an illuminated medallion 18 adapted with a light emitting device connected to conductor assemblies, generally referenced as 14 and 16, for providing illumination. Conductor assemblies 14 and 16 thus combine to form a loop conductor having first and second discontinuities, with clasp 12 located within the first discontinuity and medallion 18 located within the second discontinuity. As used herein the term "medallion" means the article or assembly attached to the necklace generally opposite the clasp, namely the decorative element that is normally positioned on the wearer's chest, and is intended to cover any suitable shape, such as a cube, figurine, number, letter, symbol, useful article, or decorative element.

Figure 5:
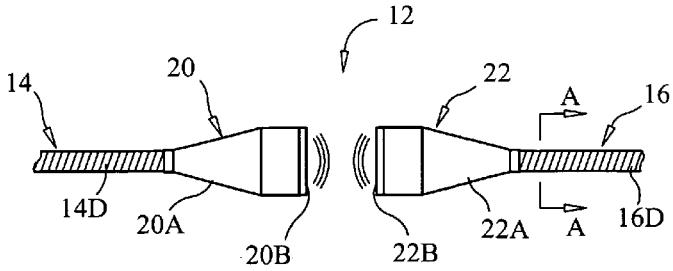
FIG. 5 is a partial detailed view of the combination battery compartment and magnetic clasp assembly in un-clasped/spaced relation.
Figure 6:
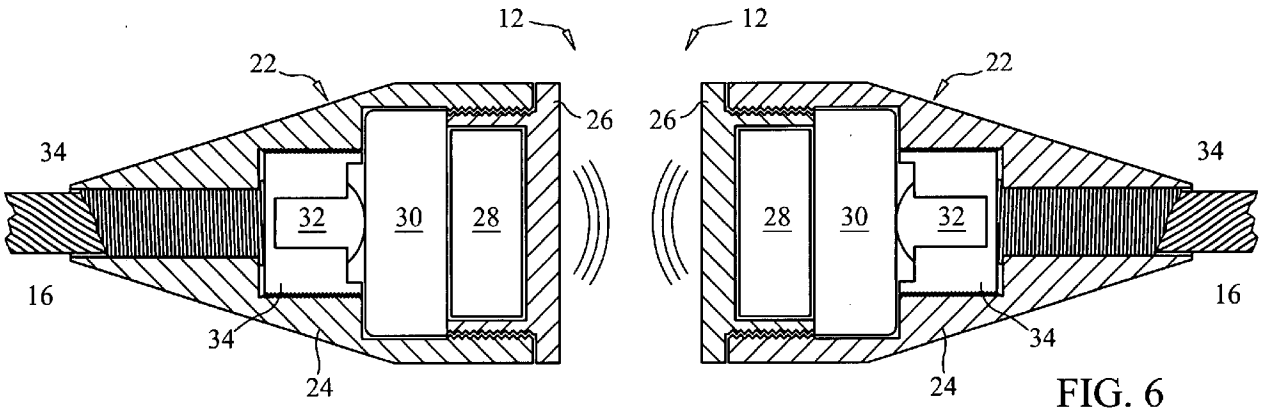
FIG. 6 is a detailed sectional view thereof in an un-clasped configuration.
Figure 7:
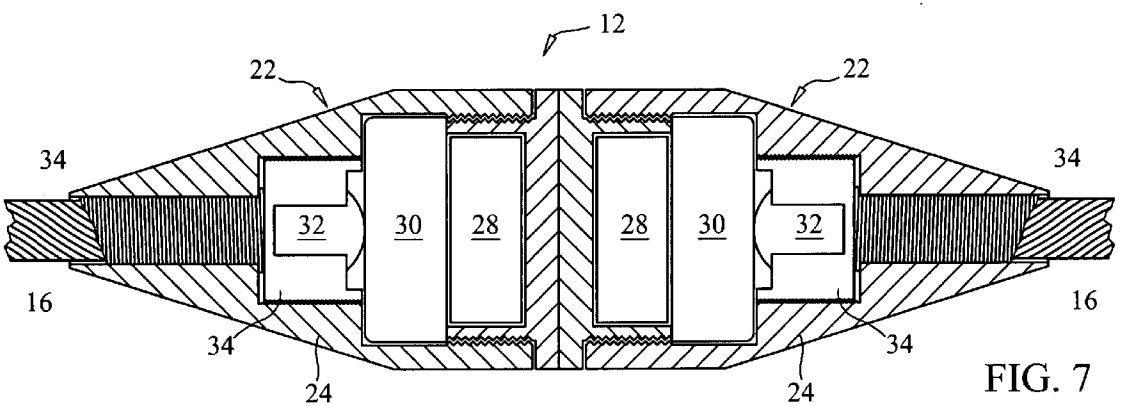
FIG. 7 is a detailed sectional view thereof in a clasped configuration.
Figure 8:
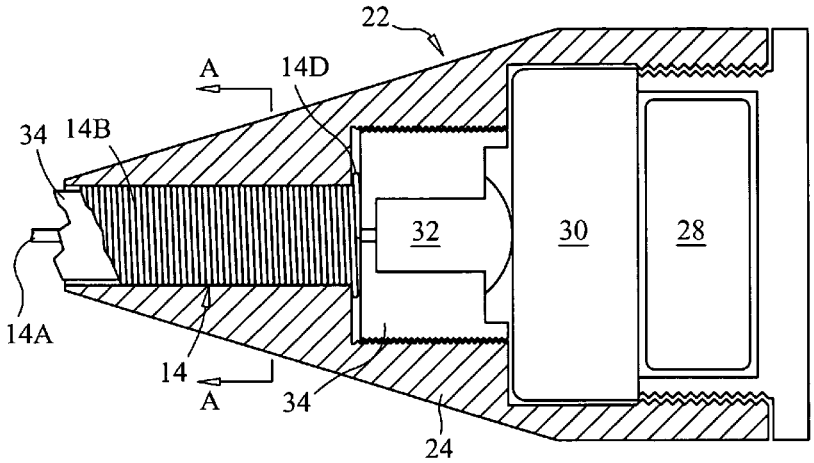
FIG. 8 is a detailed sectional view of a magnetic clasp end.
Figure 8A:
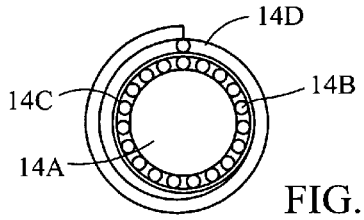
FIG. 8A is a sectional view of the conductor assembly taken along line A-A in FIG. 8.
Figure 9:
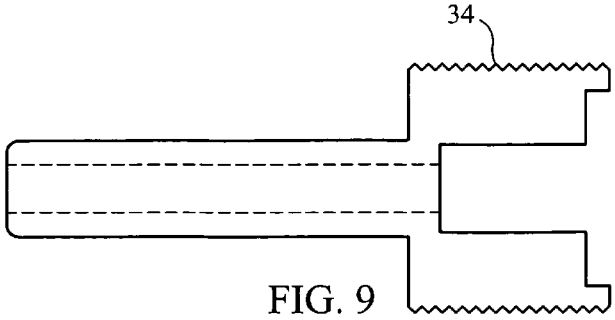
FIG. 9 depicts a conductor-retaining sleeve of the magnetic clasp.
Figure 10:
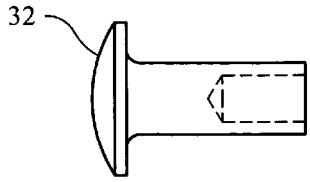
FIG. 10 depicts a conductor end fitting.
Figure 11:
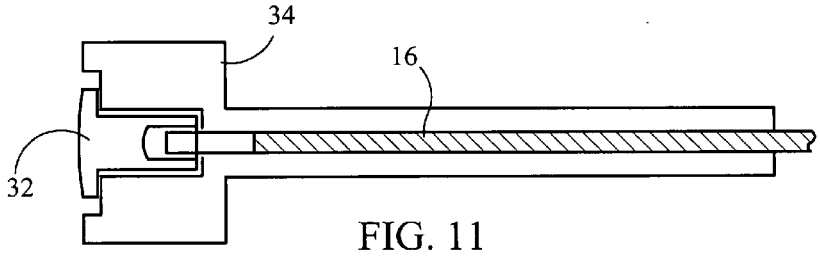
FIG. 11 depicts a wire adapted with a conductor end fitting received within a conductor retaining sleeve.
Figure 12:
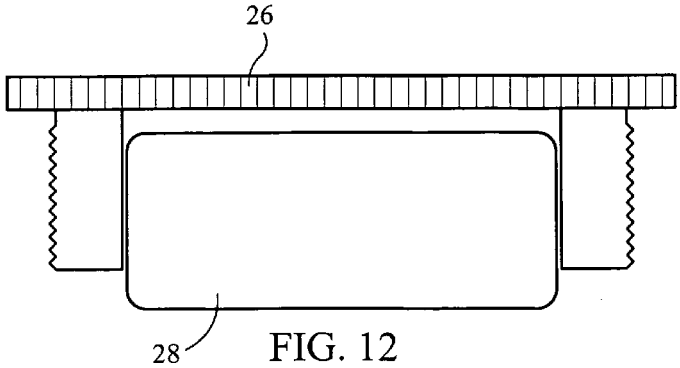
FIG. 12 depicts a threaded magnetic clasp end connector and magnet.

FIGS. 5-7 provide a detailed view of the novel clasp, referenced as 12, of the present invention. Clasp 12 includes first and first and second connectable clasp components, referenced as 20 and 22 respectively. Clasp components 20 and 22 are essentially identical mirror image components. Accordingly, identical reference numbers are used herein for identical parts thereof. Each clasp component 20 and 22 comprises a partially hollow housing formed by a main clasp body 24. Clasp components 20 and 22 are preferably conically shaped as depicted in FIG. 5, and include an end portion connected to one of the electrical conductor assemblies 14 and 16. Clasp body 24 defines an internally threaded open end 24A and an electrically conducting cap 26 in threaded engagement therewith. As seen in FIG. 12, cap 26 is externally threaded for mating threaded engagement with the internally threaded open end portion 24A of clasp body 24 as best depicted in FIGS. 6 and 7. Clasp body 24 is in removable threaded engagement with cap 26 to form a housing that contains a magnet 28 and a battery 30. Clasp body 24 is further configured for receiving an end of conductor assembly 14 (or 16) having an end fitting, referenced as 32 and depicted in FIG. 10, received within a conductor retaining sleeve 34 depicted in FIG. 11. Conductor retaining sleeve 34 further has an end of the electrical conductor assemblies 14 or 16 disposed thereon such that a radially enlarged end, referenced as 14D and 16D respectively, is formed and sandwiched between retaining sleeve 34 and main body 24 as best depicted in FIG. 8.

As best depicted in FIGS. 6, 7, 8 and 8A, each electrical conductor assembly, 14 and 16, preferably has a core conductor, referenced as 14A and 16A respectively, a plurality of stainless wires or filaments 14B/16B helically wound on conductor 14A/16A, a plastic coating 14C/16C, and a tapering helically wound outer wire 14D/16D in surrounding relation therewith. Core conductors 14A and 16A are preferably formed from a MONEL® alloy. MONEL® is a trademark of Inco Alloys International, Inc. MONEL® comprises a rustless (stainless) metal alloys primarily composed of nickel (up to 67%) and copper, with some iron and other trace elements, and thereby provides a conductor that is suitable for sodering.

A plurality of stainless wires or filaments, referenced as 14B and 16B, are preferably wrapped tightly around core conductors 14A and 16A, and provide structural strength. Stainless wires 14B and 16B function to maintain the necklace in an arcuate shape when worn and further function to prevent the conductor assembly from kinking. In addition, core conductors 14A/16A, and stainless wires 14B/16B, are externally coated with a coating of non-conductive composition, referenced as 14C/16C. Coating 14C/16C is preferably a nylon composition of approximately 0.025 inches in thickness. It should be apparent that any suitable non-conductive material is considered within the scope of the present invention.

The helically wound outer wires 14D and 16D in surrounding relation with the nylon inner conductor wires preferably taper from a larger diameter for portions thereof disposed toward the clasp end, to a smaller diameter for portions thereof disposed at the illuminated medallion end. In a preferred embodiment, helically wound wires 14D and 16D taper from a large inner diameter of approximately 0.074 inches (outer diameter of approximately 0.092 inches) at the clasp end, to a smaller inner diameter of approximately 0.028 inches (outer diameter of approximately 0.044 inches) at the illuminated end. Helically wound wires 14D and 16D are preferably fabricated from medical grade surgical stainless steel wire, such the type often used to form catheter systems. The material used for the outer wires is considered significant and is preferably selected from hypoallergenic material selections. The helically wound outer wire 14D/16D functions structurally to maintain an arcuate shape and prevent the necklace from forming a V-shape when worn. While a preferred embodiment of the present invention utilizes the conductor assembly disclosed above, it should be noted that other conductor assemblies, such as the conductor assembly disclosed above without the helical outer wires (14D and 16D), or a simple single strand copper conductor having a non-conductive outer layer, is considered within the scope of the present invention.

As illustrated in FIG. 4, illuminated necklace 10 further includes a medallion 18 adapted with a light emitting device. In a preferred embodiment, medallion comprises a transparent crystal 18B containing a miniature light emitting diode ("LED") 18A. Medallion 18 may comprise a transparent or translucent structure, or alternatively may comprise a generally opaque structure having transparent or translucent portions. Electrical power is provided to LED 18A by electrical conductor assemblies 14 and 16 that are connected thereto. An electrical circuit is completed when clasp 12 is connected such that clasp members 20 and 22 are disposed in face-to-face contacting relation as depicted in FIG. 7 More particularly, magnets 28 not only conduct electricity, but function to bias and maintain caps 26 of clasp members 20 and 22 in face-to-face relation without need for further mechanical connecting structure. The use of magnetic attachment is considered significant in providing a clasp that is easily connected by the user since the magnetic attraction between clasp members 20 and 22 help guide the clasp to the connected configuration. In addition, the user is able to undo clasp 12 by simply applying a separating force to the clasp members 20 and 22, and is thus not required to manipulate any tiny mechanical latching mechanism as commonly found on necklaces. As noted above, an electrical circuit is created when clasp 12 is connected and conducting caps 26 are in contact thereby completing an electrical circuit. Each battery 30 is preferably capable of providing a current at 1.5 Volts DC, and when clasp 12 is in the connected configuration batteries 30 are electrically connected in series so as to provide a battery output of approximately 3.0 Volts DC. As should be apparent, caps 26, magnets, 28, and conductor end fittings 32, and conductors 14 and 16, are all in electrical communication such that electrical current is allowed to flow through conductors 14 and 16 to LED 18A thereby causing illumination.

Figure 13:
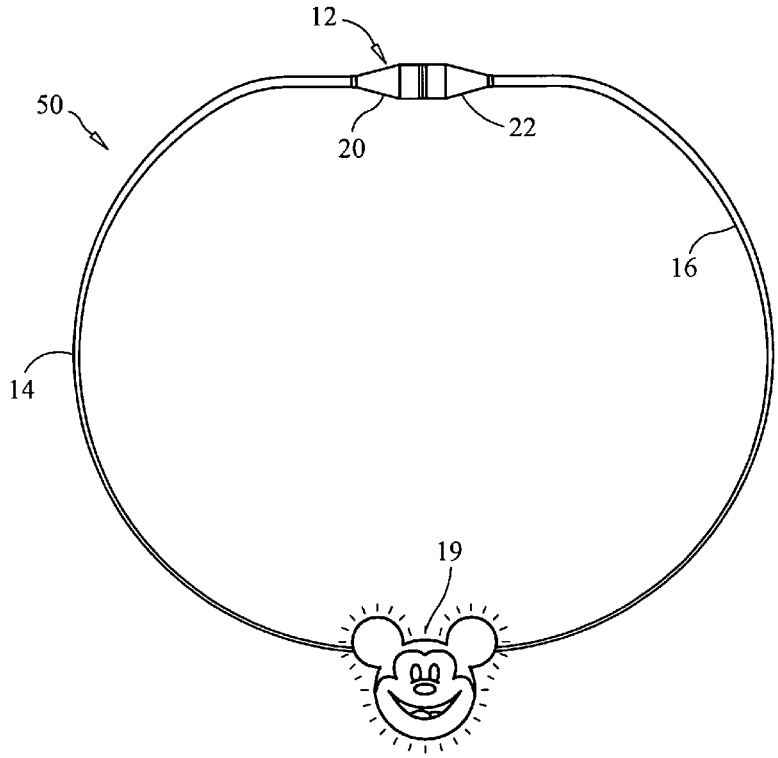
FIG. 13 depicts an alternate embodiment with an ornamental illuminated figure.

FIG. 13 depicts an alternate embodiment illuminated necklace, generally referenced as 50. Necklace 50 includes the magnetic clasp 12, having magnetically connectable clasp ends 20 and 22, and conductor assemblies 14 and 16. In addition, necklace 50 includes an alternate medallion, namely a figurine 19 having the design of a popular character. As with the previously disclosed embodiment, figurine 19 includes a transparent or translucent body 19A containing a LED electrically connected to clasp 12. As should now be apparent, the present invention may be adapted with an illuminating medallion of any suitable shape or structure.

FIGS. 14-27 depict an alternate embodiment clasp component, referenced as 100. Clasp component 100 includes a clasp body 110 having a projecting tip 112 defining a through bore 114. Clasp body 110 further defines an annular recessed groove 116 disposed in proximity to tip 112 and in surrounding relation therewith. Tip 112 functions to receive the conductor assembly 14 or 16 such that conductors 14A/16A may be insertedly received within through bore 114 for electrical connection to a battery as further discussed below. Recessed groove 116 functions to receive an end portion of helical outer wire 14D insertedly received therein in a connection configuration. Tip 112 projects from clasp body 110 so as to support helical outer wire 14D from within thereby preventing radial deformation when grasped by the user. This aspect further provides ergonomic benefits making the outer wire radially rigid thereby providing an ergonomic structure for grasping while manipulating the clasp. Clasp body 110 further defines a radial aperture 118 disposed in generally perpendicular relation with through bore 114. Radial aperture 118 functions to receive a self-tapping threaded fastener 118A therein. Fastener 118A functions to secure conductor assemblies 14 and 16 relative to clasp component 100 by engagement therewith.

Figure 14:
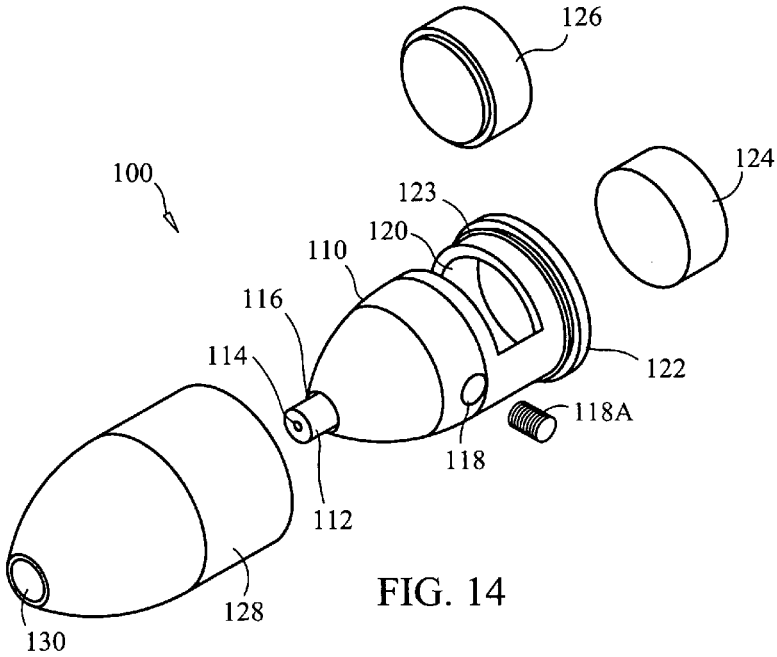
FIG. 14 is an exploded view of an alternate embodiment clasp component assembly.
Figure 15:
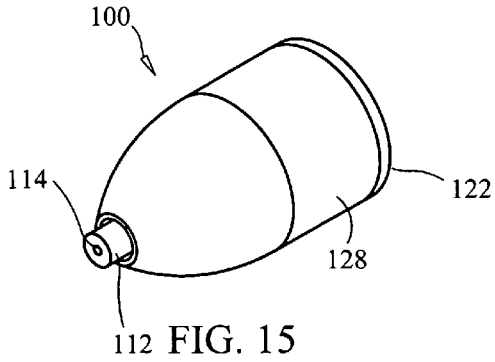
FIG. 15 is a perspective view thereof.
Figure 17:
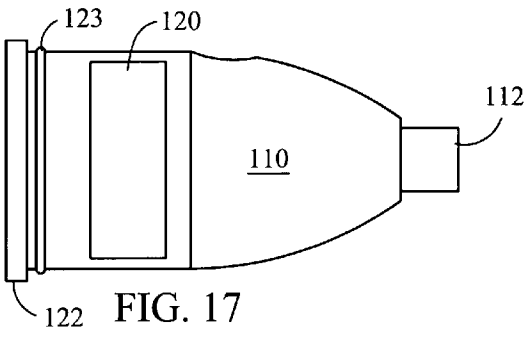
FIGS. 16-18 are side views of the alternate embodiment clasp component.
Figure 16:
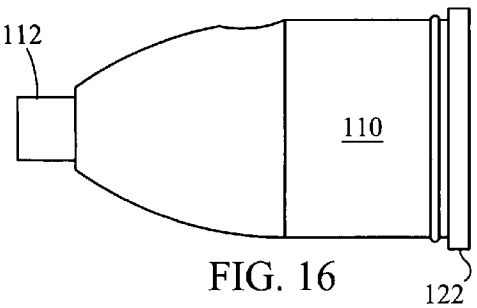
Figure 19:
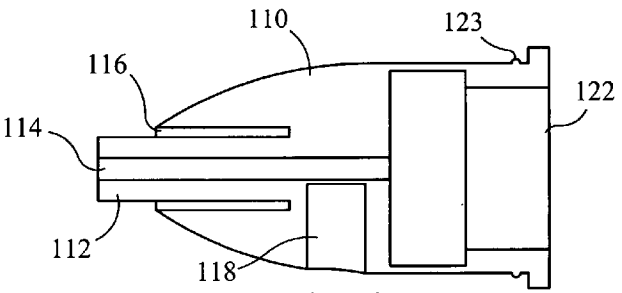
FIG. 19 is a sectional view thereof taken along section line A-A of FIG. 18.
Figure 18:
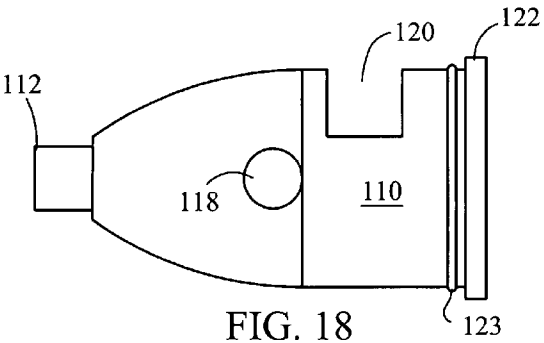
Figure 21:
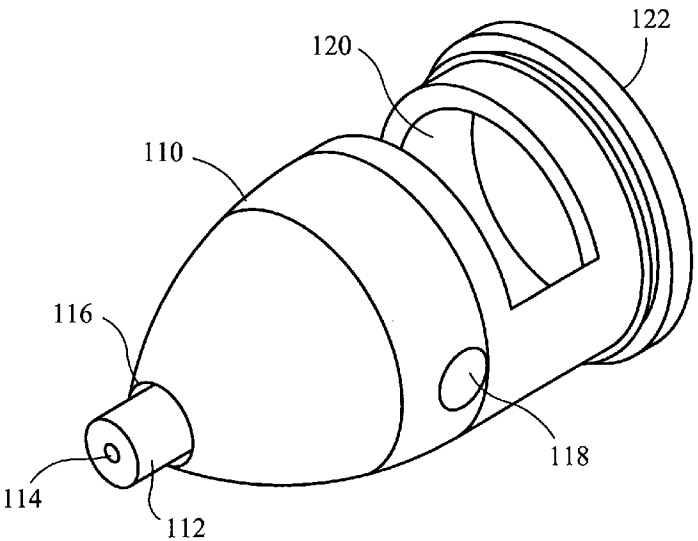
FIG. 21 is a perspective view thereof.
Figure 20:
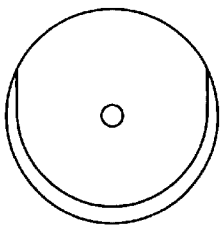
FIG. 20 is a sectional view thereof taken along section line B-B of FIG. 18.
Figure 24:
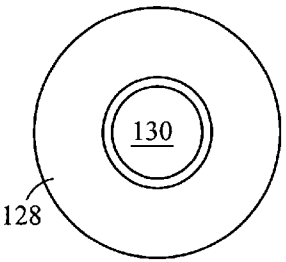
FIG. 24 is a front view thereof.
Figure 22:
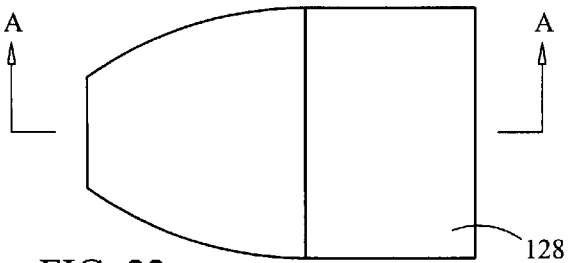
FIG. 22 is a side view of a clasp cover.
Figure 23:
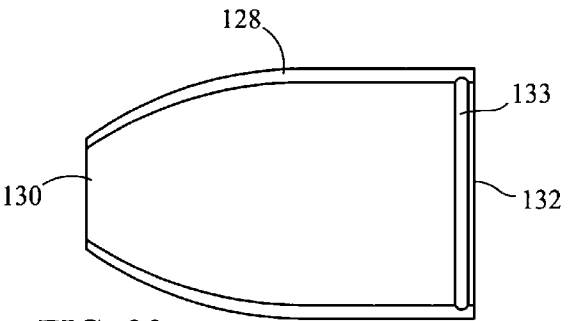
FIG. 23 is a sectional view thereof taken along section line A-A of FIG. 22.
Figure 25:
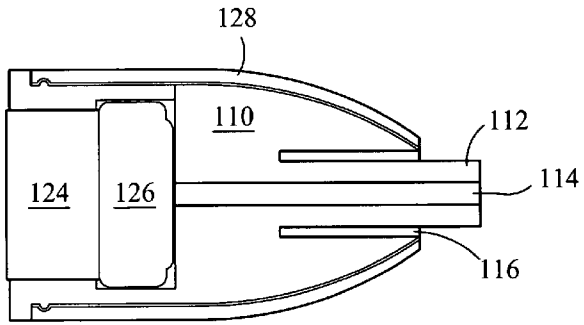
FIG. 25 is a sectional view of an assembled clasp component taken along section line A-A of FIG. 26.
Figure 26:
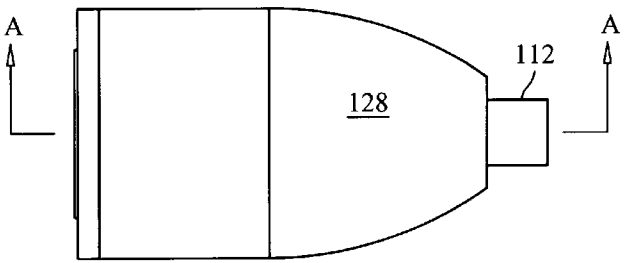
FIG. 26 is a side view of the assembled clasp.
Figure 27:
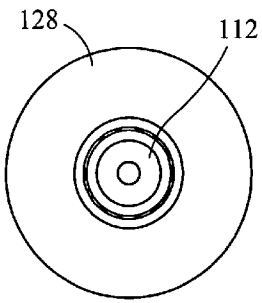
FIG. 27 is an end view thereof.

Clasp body 110 further defines a sidewall opening 120 and an end opening 122. Sidewall opening 120 is sized to provide for insertion of a battery 126 into clasp body 110, and end opening 122 is sized for receiving a magnet 124 inserted therein. Once battery 126 and magnet 124 are installed a cover, referenced as 128, is placed in covering relation with clasp body 110, as best illustrated in FIGS. 14 and 15. Cover 128 defines open ends 130 and 132. Open end 130 functions to allow tip 112 to project through cover 128. Open end 132 functions to receive clasp body 110 insertedly therein and terminates proximal end 122 of clasp body 110 when installed thereon. Clasp body 110 further includes a radially outwardly projecting circumferential lip 123, that engages a corresponding radially inwardly recessed circumferential groove 133 proximal cover end 132, which structures function to provide a detachable snap-fit connection between clasp body 110 and cover 128 as best seen in FIG. 25. As further seen in FIG. 25 magnet 124 and battery 126 fit within internal chambers defined by clasp body 110. In a preferred embodiment, magnet 124 is exposed at the base of clasp body 110. As further depicted through bore 114 provides a conduit for connection of an electrical conductor to battery 126. Battery 126 may be removed and replaced by removing cover 128, removing battery 126 through clasp body opening 120, installing a new battery, and replacing cover 128 into snap-fit engagement with clasp body 110.

The instant invention has been shown and described herein in what is considered to be the most practical and preferred embodiment. It is recognized, however, that departures may be made therefrom within the scope of the invention and that obvious modifications will occur to a person skilled in the art.

What is claimed is:

1. An article of jewelry comprising:

a generally flexible conductor assembly having a non-conductive external coating;

an outer wire wound in surrounding relation with said conductor assembly;

said conductor assembly forming a loop having first and second internal discontinuities;

a clasp located within said first discontinuity, said clasp including first and second magnetically connectable clasp members configurable from a connected configuration to a disconnected configuration;

said first and second magnetically connectable clasp members including at least one magnet configured to function as an electrical conductor when said clasp members are in said connected configuration;

said clasp adapted to receive at least one battery;

a medallion located within said second discontinuity, said medallion adapted with a light emitting device electrically connected to said conductor assembly;

whereby magnetic attraction between said first and second clasp members maintains said clasp in the connected configuration thereby completing an electrical circuit causing illumination of said light emitting device.

2. An article of jewelry according to claim 1, wherein said light emitting device comprises a light emitting diode.

3. An article of jewelry according to claim 1, wherein said outer wire tapers from a larger diameter at said first discontinuity to a smaller diameter at said second discontinuity.

4. An article of jewelry according to claim 1, wherein said light emitting device is contained within said medallion.

5. An article of jewelry according to claim 1, wherein said medallion is transparent.

6. An article of jewelry according to claim 1, wherein said medallion is translucent.

7. An article of jewelry according to claim 1, wherein said medallion comprises a figurine.

8. An article of jewelry comprising:

a generally flexible conductor assembly including a central conductor, a plurality of stainless steel wires wrapped helically around said central conductor, a non-conductive coating disposed over said stainless steel wires, and an outer coil in surrounding relation with said external coating;

said conductor assembly forming a loop having first and second internal discontinuities;

a clasp located within said first discontinuity, said clasp including first and second clasp members, each clasp member including a battery electrically connected to said conductor assembly, and a magnet whereby said clasp members are magnetically connectable;

a medallion located within said second discontinuity, said medallion adapted with a light emitting device electrically connected to said conductor assembly;

whereby magnetic attraction between said first and second clasp members maintains said clasp in the connected configuration thereby completing an electrical circuit causing illumination of said light emitting device.

9. An article of jewelry according to claim 8, wherein said light emitting device comprises a light emitting diode.

10. An article of jewelry according to claim 8, wherein said outer wire tapers from a larger diameter at said first discontinuity to a smaller diameter at said second discontinuity.

11. An article of jewelry according to claim 8, wherein said light emitting device is contained within said medallion.

12. An article of jewelry according to claim 8, wherein said medallion is transparent.

13. An article of jewelry according to claim 8, wherein said medallion is translucent.

14. An article of jewelry according to claim 8, wherein said medallion comprises a figurine.

15. An article of jewelry according to claim 14, wherein said figurine is a character.

* * * * *